US007252731B2

(12) United States Patent
Kaneko et al.

(10) Patent No.: US 7,252,731 B2
(45) Date of Patent: Aug. 7, 2007

(54) APPARATUS AND METHOD FOR APPLYING DOUBLE-COATED PRESSURE SENSITIVE ADHESIVE TAPE, AND METHOD FOR PRODUCING CATALYTIC CONVERTER

(75) Inventors: Shinichi Kaneko, Kanagawa (JP); Taishi Tokunaga, Yamato (JP); Hideo Matsumoto, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 388 days.

(21) Appl. No.: 10/432,117

(22) PCT Filed: Nov. 20, 2001

(86) PCT No.: PCT/US01/43374

§ 371 (c)(1),
(2), (4) Date: May 19, 2003

(87) PCT Pub. No.: WO02/42617

PCT Pub. Date: May 30, 2002

(65) Prior Publication Data

US 2004/0031556 A1 Feb. 19, 2004

(30) Foreign Application Priority Data

Nov. 20, 2000 (JP) ..... 2000-353131

(51) Int. Cl.
*B65H 81/00* (2006.01)

(52) U.S. Cl. ..... 156/185; 156/187; 156/188; 156/192

(58) Field of Classification Search ..... 156/447, 156/475, 537, 443, 449; 242/443.1, 443
See application file for complete search history.

(56) References Cited

U.S. PATENT DOCUMENTS

| | | | | |
|---|---|---|---|---|
| 4,816,109 | A * | 3/1989 | Ingram | 156/443 |
| 5,459,976 | A * | 10/1995 | Weder et al. | 53/397 |
| 5,862,590 | A | 1/1999 | Sakashita et al. | |
| 5,940,962 | A | 8/1999 | Shima et al. | |
| 6,162,404 | A | 12/2000 | Tojo et al. | |
| 6,220,331 | B1 * | 4/2001 | Matsuda et al. | 156/566 |

FOREIGN PATENT DOCUMENTS

| | | |
|---|---|---|
| EP | 0 196 767 A2 | 10/1986 |
| EP | 0 810 353 A1 | 12/1997 |
| JP | 58204751 | 11/1983 |
| JP | 61150637 | 7/1986 |
| JP | 2000-135747 | 5/2000 |
| WO | WO 00/1098 | 3/2000 |

* cited by examiner

*Primary Examiner*—Jeff H. Aftergut
(74) *Attorney, Agent, or Firm*—Harold C. Knecht, III

(57) ABSTRACT

An application apparatus is provided with an object supporting section including a support surface for supporting an object; a tape carrying section for rotatably carrying, in a roll form, a double-coated pressure sensitive adhesive tape with a release paper attached to one side of the tape; and a tape laying section for holding the double-coated pressure sensitive adhesive tape with the release paper, fed in a strip form from the tape carrying section, in a condition where the tape is laid on the support surface of the object supporting section with an adhesive surface of the tape to which the release paper is not attached facing outward. Further provided is a tape cutting section.

3 Claims, 11 Drawing Sheets

APPARATUS AND METHOD FOR APPLYING DOUBLE-COATED PRESSURE SENSITIVE ADHESIVE TAPE, AND METHOD FOR PRODUCING CATALYTIC CONVERTER

FIELD OF THE INVENTION

The present invention relates to an application apparatus and an application method, for winding and applying a double-coated pressure sensitive adhesive tape around a surface of an object. Further, the present invention relates to a method for producing a catalytic converter for cleaning exhaust gas.

BACKGROUND OF THE INVENTION

In a catalytic converter for cleaning exhaust gas of an automobile, a monolithic type carrier is generally accommodated in a metallic shell while covered on the outer circumference thereof with a mat having various functions of retention, cushioning or sealing. The mat is made of a flexible flat sheet mainly composed of ceramic fibers and wound around substantially entirely the cylindrical outer circumference of the carrier. Usually, the mat is secured to the carrier not to move within the interior of the metallic shell. A double-coated pressure sensitive adhesive tape capable of being easily handled is used as such securing means.

The catalytic converter of the above-mentioned structure is conventionally assembled in the following manner. First, the mat cut to have a desired shape is disposed in a flatly extended state, and the double-coated pressure sensitive adhesive tape having a release paper clad on one surface thereof is located and adhered to a proper position of one surface of the mat. Then, the release paper is peeled off from the adhered double-coated pressure sensitive adhesive tape. Subsequently, the mat is wound around the outer circumference of the carrier while the surface of the mat carrying the double-coated pressure sensitive adhesive tape is in tight contact with the outer circumference of the carrier, whereby the mat is fixed thereto by the double-coated pressure sensitive adhesive tape. And, the carrier is accommodated in the metallic shell together with the mat secured to the outer circumference thereof.

SUMMARY OF THE INVENTION

While various structures of the mat used in the catalytic converter have been known, there is a risk in a mat which is low in bulk density and rich in softness, during the conventional procedure of assembling the catalytic converter described above. That is, in such a case, when the double-sided adhesive tape is adhered in advance onto one surface of the mat, it is difficult to adhere the double-coated pressure sensitive adhesive tape to a proper position on a soft mat surface with a uniform pressure all over a total length thereof. Also, when the release paper is peeled off from the double-coated pressure sensitive adhesive tape adhered to the mat surface, there is a risk in that a surface structure of the mat may be damaged by a tensile force applied to the double-coated pressure sensitive adhesive tape via the release paper.

To avoid the above-mentioned inconvenience, a procedure may be adopted in that a double-coated pressure sensitive adhesive tape is initially applied not to a mat but to a cylindrical outer circumference of a carrier, and, after peeling off a release paper from the adhesive tape, the mat is wound and fixed around the carrier. According to this procedure, however, the double-coated pressure sensitive adhesive tape is difficult to be wound and applied to a proper position on the cylindrical outer circumference of the carrier. Particularly, when a plurality of the double-coated pressure sensitive adhesive tapes are adhered to one carrier, there are problems in that it is difficult to apply them in a stable and reproducible manner, the operating time becomes too long, and skill of the operator is required.

An object of the present invention is to provide an application apparatus of a double-coated pressure sensitive adhesive tape, capable of quickly and properly winding and applying any number of double-coated pressure sensitive adhesive tapes around a surface of an object so that the object clad with the adhesive tapes is obtainable in a stable manner without requiring skill of the operator, and an application method thereof.

Another object of the present invention is to provide a method for producing a catalytic converter, capable of properly adhering a mat onto an outer circumference of a carrier with a double-coated pressure sensitive adhesive tape even if the carrier is covered with the soft and porous mat, while securely preventing the mat surface structure from being damaged due to the application procedure of the double-coated pressure sensitive adhesive tape.

In one aspect of the present invention, an application apparatus is provided for winding and applying a double-coated pressure sensitive adhesive tape around a surface of an object. The application apparatus comprises: an object supporting section including a support surface for supporting an object while allowing a free rolling of the object; a tape carrying section for rotatably carrying, in a roll form, a double-coated pressure sensitive adhesive tape with a release paper attached to one side of the tape; a tape laying section for holding the double-coated pressure sensitive adhesive tape with the release paper, fed in a strip form from the tape carrying section, in a condition where the tape is laid on the support surface of the object supporting section with an adhesive surface of the tape to which the release paper is not attached facing outward; and a tape cutting section provided between the object supporting section and the tape carrying section for acting on the double-coated pressure sensitive adhesive tape with the release paper, held on the support surface by the tape laying section, so as to cut only the double-coated pressure sensitive adhesive tape at a desired position while leaving the release paper on the support surface.

It can be desirable for the tape laying section to comprise a locating mechanism for locating the double-coated pressure sensitive adhesive tape with the release paper, fed in the strip form from the tape carrying section, at a desired position on the support surface of the object supporting section.

It can also be desirable for the object supporting section to be joined to a covering-material supporting section for supporting a covering material capable of covering a surface of the object, so that the object, on the surface of which the double-coated pressure sensitive adhesive tape has been applied in the object supporting section, can be subsequently rolled on the covering material supported on the covering-material supporting section so as to wind and affix the covering material around the surface of the object via the double-coated pressure sensitive adhesive tape.

In another aspect of the present invention, an application method is provided for winding and applying a double-coated pressure sensitive adhesive tape around a surface of an object. The method comprises: providing a support surface for supporting an object while allowing a free rolling of the object; holding a double-coated pressure sensitive adhesive tape with a release paper attached to one side of the tape in a condition where the tape is laid on the support surface with an adhesive surface of the tape to which the release paper is not attached facing outward; rolling the object on the support surface so as to wind and apply the double-coated pressure sensitive adhesive tape around a surface of the object while automatically peeling the release paper; and cutting the double-coated pressure sensitive adhesive tape at a trailing end of a tape portion applied on the surface of the object while leaving the release paper on the support surface.

It can be desirable for the step of holding the double-coated pressure sensitive adhesive tape in the condition where the tape is laid on the support surface to include locating the double-coated pressure sensitive adhesive tape at a desired position on the support surface.

In an additional aspect of the present invention, a method is provided for producing a catalytic converter for an exhaust emission control. The method comprises: applying a double-coated pressure sensitive adhesive tape on an outer peripheral surface of a carrier at a predetermined position through the application method defined in claim 5; and winding and fixing a mat having a flat-plate shape around the outer peripheral surface of the carrier via the double-coated pressure sensitive adhesive tape.

DETAILED DESCRIPTION OF THE INVENTION

Figure 1:
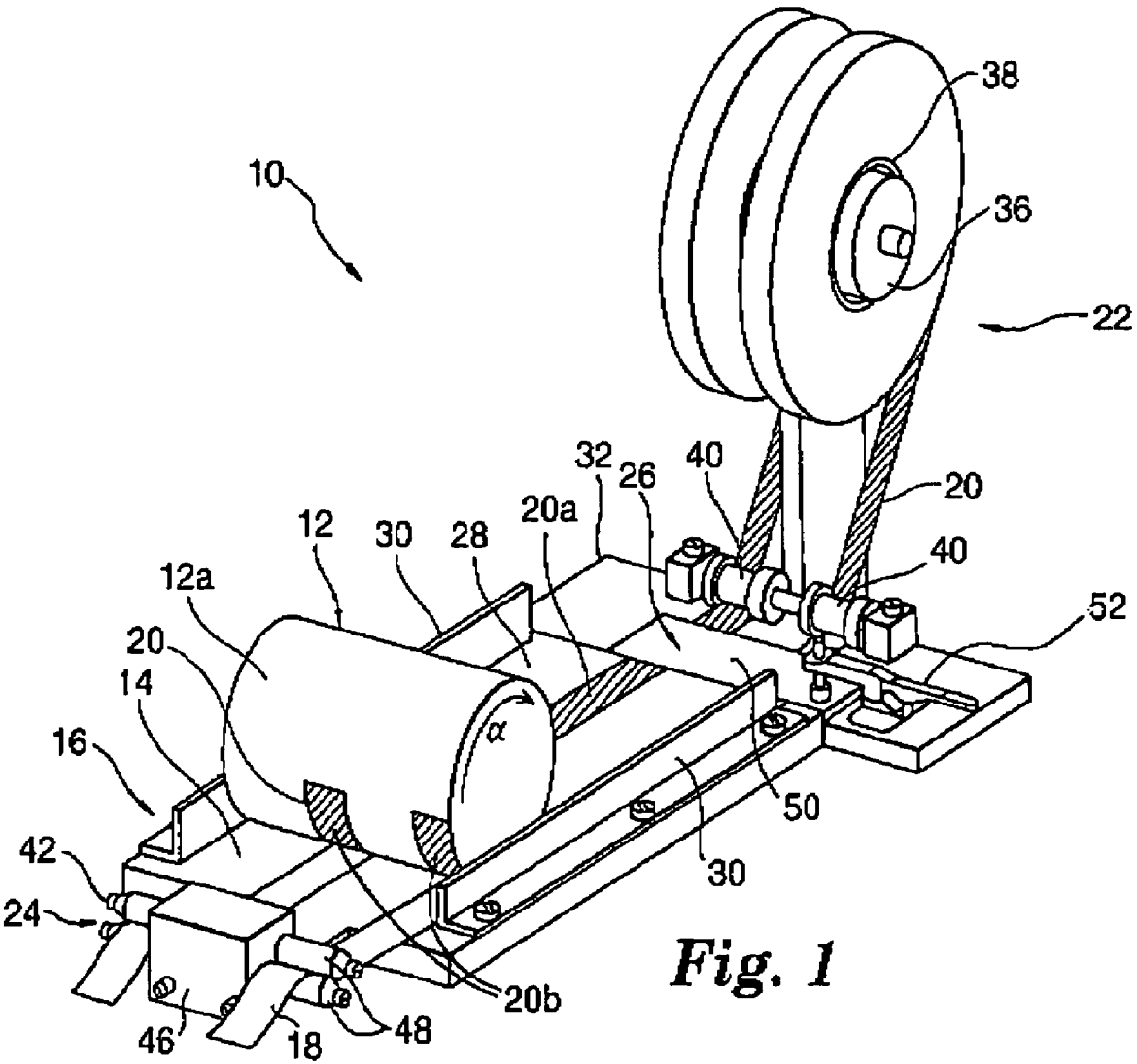
FIG. 1 is a perspective view of one embodiment of an application apparatus according to the present invention during the application operation.

Embodiments of the present invention will be described below with reference to the attached drawings. In the drawings, common reference numerals are used for denoting the same or similar components.

Figure 2:
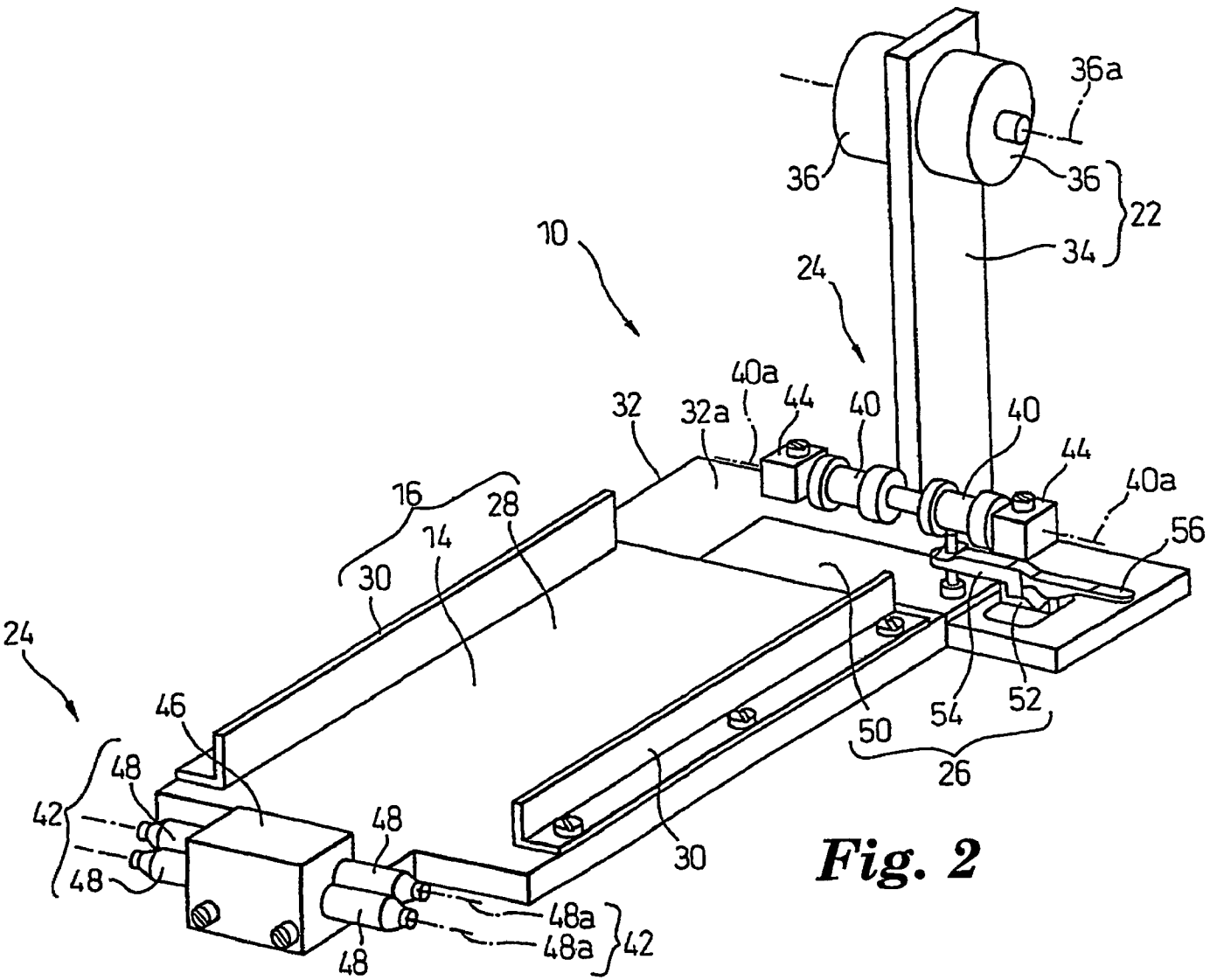
FIG. 2 is a perspective view of the application apparatus of FIG. 1 in a non-used state.

As shown in FIGS. 1 and 2, an application apparatus 10 according to one embodiment of the present invention includes an object supporting section 16 having a support surface 14 for supporting an object 12 in a rotatable manner, a tape carrying section 22 for supporting in a rotatable manner a double-coated pressure sensitive adhesive tape 20 of a roll form carrying a release paper 18 on one surface thereof, a tape laying section 24 for laying and holding the double-coated pressure sensitive adhesive tape 20 having the release paper 18 and delivered in a strip form from the tape carrying section 22 on the support surface 14 while an adhesive surface 20*a* with no release paper 18 faces outward, and a tape cutting section 26 for cutting at a desired position the double-coated pressure sensitive adhesive tape 20 held on the support surface 14 while leaving the release paper 18 as it is.

The object supporting section 16 is provided with a flat plate-shaped base 28 having a flat support surface 14. The base 28 has a rigidity for retaining its configuration against an external force caused by the object 12 rolling on the support surface 14. The object supporting section 16 is further provided with a pair of guide walls 30 located at an interval parallel to each other on the support surface 14 of the base 28. These guide walls 30 are brought into contact with opposite ends of the object 12 as seen in the axial direction of the rotation of the object 12 rolling on the support surface 14 to guide the object 12 in the longitudinally extending direction of both the guide walls 30. In this regard, while the object 12 is illustrated as a cylindrical body, the application apparatus 10 may be used for other various columnar bodies having a cross-sectional shape such as an oval or a polygon, rotatable on the flat support surface 14.

Figure 3:
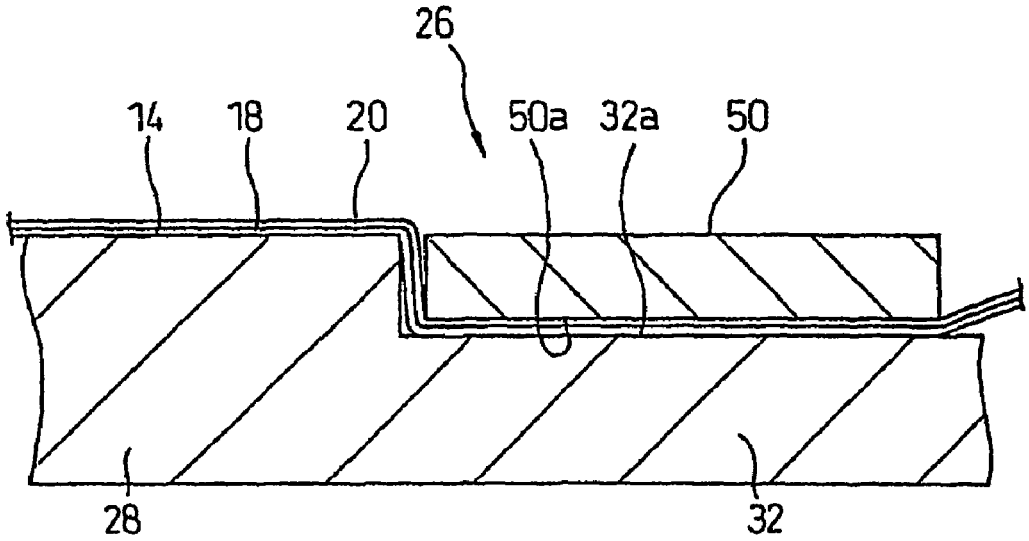
FIG. 3 is an enlarged sectional view of a tape-cutting section in the application apparatus shown in FIG. 1.
Figure 4:
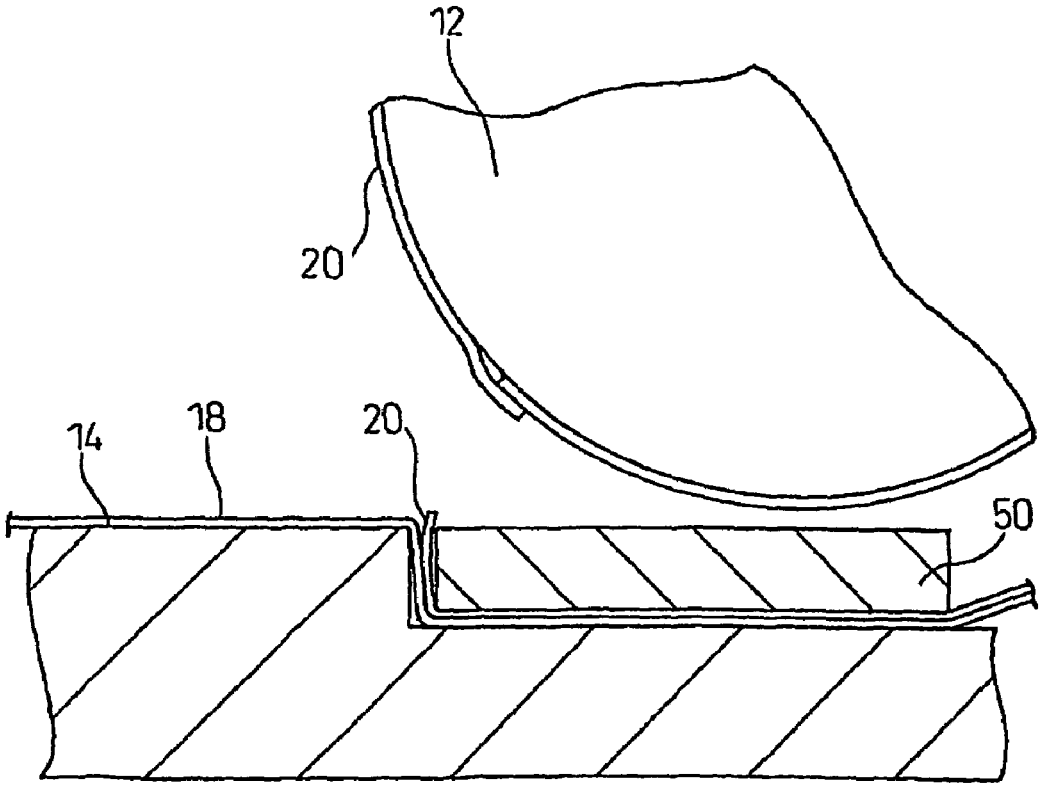
FIG. 4 is an enlarged sectional view of the tape-cutting section shown in FIG. 3, illustrating the cutting operation.

The base 28 of the object supporting section 16 is integrally connected by one edge thereof adjacent a longitudinal distal end of the pair of guide walls 30 to a flat plate-shaped second base 32 having an upper surface 32*a* extending parallel to the support surface 14. The upper surface 32*a* of the second base 32 is disposed at a position somewhat lower than the support surface 14 of the base 28 (see FIG. 3).

The tape carrying section 22 is disposed on the extension of a rolling path of the object 12 in the object supporting section 16. The tape carrying section 22 is provided with a column 34 stationarily stands on the upper surface 32*a* of the second base 32, and a pair of roll attachment plates 36 attached in a rotatable manner on both sides of the column 34 in the vicinity of the upper end thereof A rotary axis 36*a* of the respective roll attachment plates 36 extends substantially vertical to the longitudinal direction of both the guide walls 30 on the base 28; that is, substantially parallel to the rotary axis of the object 12 on the base 28. On the respective roll attachment plates 36, a reel 38 is fixedly attached, around which is wound a striplike double-coated pressure sensitive adhesive tape 20 with a release paper 18 to form multi-layers. In this regard, it is also possible to directly attach the roll-shaped double-coated pressure sensitive adhesive tape with the release paper to the roll attachment plate 36 without using the reel 38.

The tape laying section 24 includes a pair of guide rollers 40 arranged on the upper surface 32*a* of the second base 32 in the vicinity of the column 34 and a pair of nip roller assemblies 42 arranged opposite to the second base 32 while interposing the base 28. The pair of guide rollers 40 and the pair of nip roller assemblies 42 are co-operated with each other to act as a positional mechanism for locating the double-coated pressure sensitive adhesive tape 20 with the release paper 18 continuously delivered in a strip form from the tape carrying section 22 to a desired position on the support surface 14 of the object supporting section 16 to define thereby a tape-feeding path on the support surface 14 and the second base upper surface 32*a*.

The pair of guide rollers 40 are disposed at positions slightly deviated from those directly beneath both the roll attachment plates 36 toward the base 28. Each of the guide rollers 40 has a rotary axis 40*a* parallel to each of the roll attachment plates 36 and is pivoted to a lateral side of a pivot base 44 fixedly provided on the upper surface 32*a* of the second base 32. In this regard, as described later, since the respective guide roller 40 rotates while the outer circumference thereof being in contact with the adhesive surface 20*a* to guide the double-coated pressure sensitive adhesive tape with the release paper 18 in the predetermined direction, at least the outer circumference of the guide roller is preferably formed of a material (for example, polyacetal) to which the adhesive is hardly adhered.

The pair of nip roller assemblies 42 are provided on opposite sides of one pivot basc 46, respectively, connected to the other edge of the base 28 so as to be substantially opposed to a pair of guide rollers 40 as seen in the longitudinal direction of both the guide walls 30 on the base 28. The respective nip roller assembly 42 has a pair of nip rollers 48 pivoted to one side of the pivot base 46. Each of the two nip rollers 48 in the assembly has a rotary axis 48*a* parallel to the rotary axis 40*a* of the respective guide roller 40, and a nip is formed between the outer circumferences thereof for puffing the release paper 18 peeled off from the double-coated pressure sensitive adhesive tape 20 between them. The respective nip roller assembly 42 incorporates with a one-way clutch (not shown) in at least one of the nip rollers 48, for preventing the release paper 18 nipped thereby from reversely running.

The tape cutting section 26 includes a flat presser plate 50 disposed on the upper surface 32*a* of the second base 32 adjacent to the base 28 and a clamp mechanism 52 for holding the presser plate 50 on the upper surface 32*a* of the second base 32 in a fixed state. The presser plate 50 has a flat lower surface 50*a* (see FIG. 3) and is coupled to the second base 32 to be movable between a closed position (FIG. 3) for securely nipping the double-coated pressure sensitive adhesive tape 20 with the release paper 18 between the lower surface 50*a* and the second base upper surface 32*a* while approaching the both to each other and an open position for separating the lower surface 32*a* from the upper surface 32*a* of the second base to release the double-coated pressure sensitive adhesive tape 20 with the release paper 18 from the nip, by means, for example, of a hinge mechanism (not shown). The presser plate 50 has a rigidity capable of at least retaining its shape against external force applied from the double-coated pressure sensitive adhesive tape 20 nipped between the lower surface 50*a* and the second base upper surface 32*a* Also, at least the lower surface 50*a* of the presser plate 50 is preferably formed of a material to which the adhesive is hardly adhered.

The clamp mechanism 52 has a pair of levers 54, 56 supported on the upper surface 32*a* of the second base 32 in a rockable manner, and securely holds the presser plate 50 at the closed position by anchoring one lever 56 while engaging a free end of the other lever 54 with the presser plate 50. Also, by operating the lever 56 to release a free end of the lever 54 from the presser plate 50, the closing and opening motion of the presser plate 50 is allowed. In this regard, various known structures may be adopted as the clamp mechanism 52, such as a spring-biased latch or others.

Steps of the application of the double-coated pressure sensitive adhesive tape 20 onto an outer circumference 12*a* via the application apparatus 10 of the above-mentioned structure will be described below.

Initially, as shown in FIG. 1, the pair of reels 38, around which is wound multilayers of the double-coated pressure sensitive adhesive tape 20 while the release paper 18 faces outward, are fixedly attached, respectively, to the pair of roll-attachment plates 36 of the tape carrying section 22. Then, while locating the presser plate 50 of the tape cutting section 26 at the open position, the double-coated pressure sensitive adhesive tape 20 with the release paper 18 is continuously withdrawn from the respective reel 38, and halfwrapped around the respective guide roller 40 located at a corresponding position with the adhesive surface 20*a* being in contact with the outer circumference thereof to pass the adhesive tape between the guide roller 40 and the second base upper surface 32*a* At that time, a predetermined length from a leading end of the double-coated pressure sensitive adhesive tape 20 withdrawn from the respective reel 38 is removed in advance while leaving the release paper 18.

A length of the double-coated pressure sensitive adhesive tape 20 with the release paper 18 sufficient for reaching the other longitudinal edge of the support surface 14 is further withdrawn from this state, while its adhesive surface faces outward or upward, so that a leading end area of the release paper 18 from which is removed the double-coated pressure sensitive adhesive tape 20 is inserted and nipped between the two nip rollers 48 of the respective nip roller assembly 42 located at the position corresponding to the respective guide roller 40. The respective nip roller assembly 42 holds the release paper 18 nipped thereby and the succeeding double-coated pressure sensitive adhesive tape 20 attached with this release paper 18, so that they do not return back to the corresponding guide roller 40. In this state, two double-coated pressure sensitive adhesive tapes 20 with the release paper delivered from the pair of reels 38 are located at predetermined positions, respectively, on the support surface 14 of the base 28 and laid substantially parallel to both the guide walls 30.

Then, the presser plate 50 is moved from the open position to the closed position to anchor the clamp mechanism 52, whereby the double-coated pressure sensitive adhesive tapes 20 with the release paper 18 are fixedly nipped between the upper surface 32*a* of the second base 32 and the lower surface 50*a* of the presser plate 50. Thereby, these double-coated pressure sensitive adhesive tapes 20 are held on the support surface 14 while facing the adhesive surface 20*a* upward and making the release paper 18 substantially in contact with the support surface 14. In this regard, at this time, a position of the leading end of the double-coated pressure sensitive adhesive tape 20 is positioned, for example, by coinciding the same with a mark put on the support surface 14, so that an exposed length of the double-coated pressure sensitive adhesive tape 20 in which the adhesive surface 20*a* is exposed on the support surface 14 is substantially equal to a circumferential length of a circular cross-section taken along a plane vertical to the rotary axis of the object to be adhered.

When the above-mentioned preparation step has completed, the object 12 is placed on the support surface 14 with the axial opposite ends thereof in contact with the pair of guide walls 30 on the base 28. At this time, it is possible to define a position at which the object 12 starts the rotation by making the nip roller assembly 42 to be in contact with the pivot base 46 for pivoting the nip roller assembly 42. In this regard, when the object 12 is placed at the rotation starting position, the outer circumference 12*a* of the object 12 is not yet brought into contact the double-coated pressure sensitive adhesive tape 20 but preferably disposed as close to the leading end of the double-coated pressure sensitive adhesive tape 20 as possible.

Subsequently, the object 12 is rolled on the support surface 14 in the arrowed direction a along both the guide walls 30. Thereby, the object 12 rotates on the two double-coated pressure sensitive adhesive tapes 20, and accompanied therewith, both the double-coated pressure sensitive adhesive tapes 20 are simultaneously and gradually wound around the outer circumference 12*a* of the object 12 from the leading ends thereof. A required pressure applied to the double-coated pressure sensitive adhesive tape 20 is obtained by a weight of the object 12 itself and, if necessary, by pressing the object 12 onto the support surface 14. At this time, since the release paper 18 is prevented from moving backward by the nip roller assembly 42 on the upstream side of the tape-feeding direction on the support surface 14 as well as fixedly nipped by the lower surface 50*a* of the presser plate 50 on the downstream side, it is held substantially to be in contact with the support surface 14. As a result, while the double-coated pressure sensitive adhesive tape 20 is being adhered to the outer circumference 12*a* of the object 12, the release paper 18 is automatically and gradually peeled off from the double-coated pressure sensitive adhesive tape 20.

When the object 12 is made to rotate on the support surface 14 to a boundary between the base 28 and the second base 32, a length of the two double-coated pressure sensitive adhesive tapes 20 corresponding to substantially one round of the outer circumference 12*a* of the object 12 is wound and adhered there around. At this time, a trailing end area of the one round length 20' of the respective adhered double-coated pressure sensitive adhesive tape 20 is aligned with the leading edge of the same double-coated pressure sensitive adhesive tape 20, for example, in a slightly overlapped state. When the object 12 is further made to rotate to ride on the presser plate 50 and preferably lifted up above the presser plate 50, the respective double-coated pressure sensitive adhesive tape 20 is solely torn while leaving the release paper 18 on the support surface 14. In such a manner, the two double-coated pressure sensitive adhesive tapes 20 are properly located and accurately adhered to a predetermined position on the outer circumference 12*a* of the object 12 so that the adhesive surface 20*b* from which the released paper 18 has been peeled off is exposed outward.

When the adhering operation of the tapes 20 to one object 12 has completed, the clamp mechanism 52 is released to move the presser plate 50 from the closed position to the open position, after which the leading end area of the release paper 18 nipped by the respective nip roller assembly 42 is pulled further forward to continuously withdraw the subsequent double-coated pressure sensitive adhesive tape 20 with the release paper from the respective reel 38. At this time, the respective double-coated pressure sensitive adhesive tape 20 with the release paper is advanced with the adhesive surface 20*a* thereof being in contact with the outer circumference of the corresponding guide roller 40, and guided in the direction parallel to both the guide walls 30 by the co-operation of the guide roller 40 with the nip roller assembly 42. And, when the leading edge of the subsequent double-coated pressure sensitive adhesive tape 20 reaches the predetermined position on the support surface 14, the withdrawal of the tape has finished, and the presser plate 50 is moved back to the closed position to clamp the tape. In such a manner, the adhering operation of the second object 12 has completed.

As described above, according to the application apparatus 10 and the application method carried out by using the same, it is possible to quickly and properly wind and adhere the two double-coated pressure sensitive adhesive tapes 20 around the surface 12*a* of object 12 merely by rolling the object 12 on the support surface 14. These two double-coated pressure sensitive adhesive tapes 20 are automatically applied to the predetermined position on the objective surface 12*a* in synchronism with each other while receiving a uniform pressure throughout their whole lengths by a pressure applied in a stable manner between the objective surface 12*a* and the support surface 14. Accordingly, it is possible to produce an object with adhesive tapes in a stable manner without the need of operator's skill.

The application apparatus 10 is particularly suitably used when a catalytic converter for cleaning exhaust gas is assembled. For example, it is possible to properly apply the two double-coated pressure sensitive adhesive tapes 20 at a predetermined position on an outer circumference of a cylindrical carrier used as the object 12 in accordance with the above-mentioned procedure. On the other hand, a flat sheet-like mat (not shown) cut to have a desired shape to cover the outer circumference of the carrier is disposed on a suitable flat surface in an extended state. The carrier clad with the double-coated pressure sensitive adhesive tapes 20 on the outer circumference thereof is rolled on the mat, whereby the mat is wound around the outer circumference of the carrier via the double-coated pressure sensitive adhesive tapes 20 and fixed thereto. According to this procedure, even if a mat low in bulk density and rich in softness is used, it is possible to apply a uniform pressure throughout a whole length of the double-coated pressure sensitive adhesive tape and to avoid the breakage of a surface structure of the mat caused by the peeling operation of the release paper. Thus, the mat can be quickly and properly fixed to the outer circumference of the carrier. In such a case, the same effect is obtainable by winding the mat around the outer circumference of the carrier by hands.

The above-mentioned application apparatus may be variously modified as described below.

Figure 5:
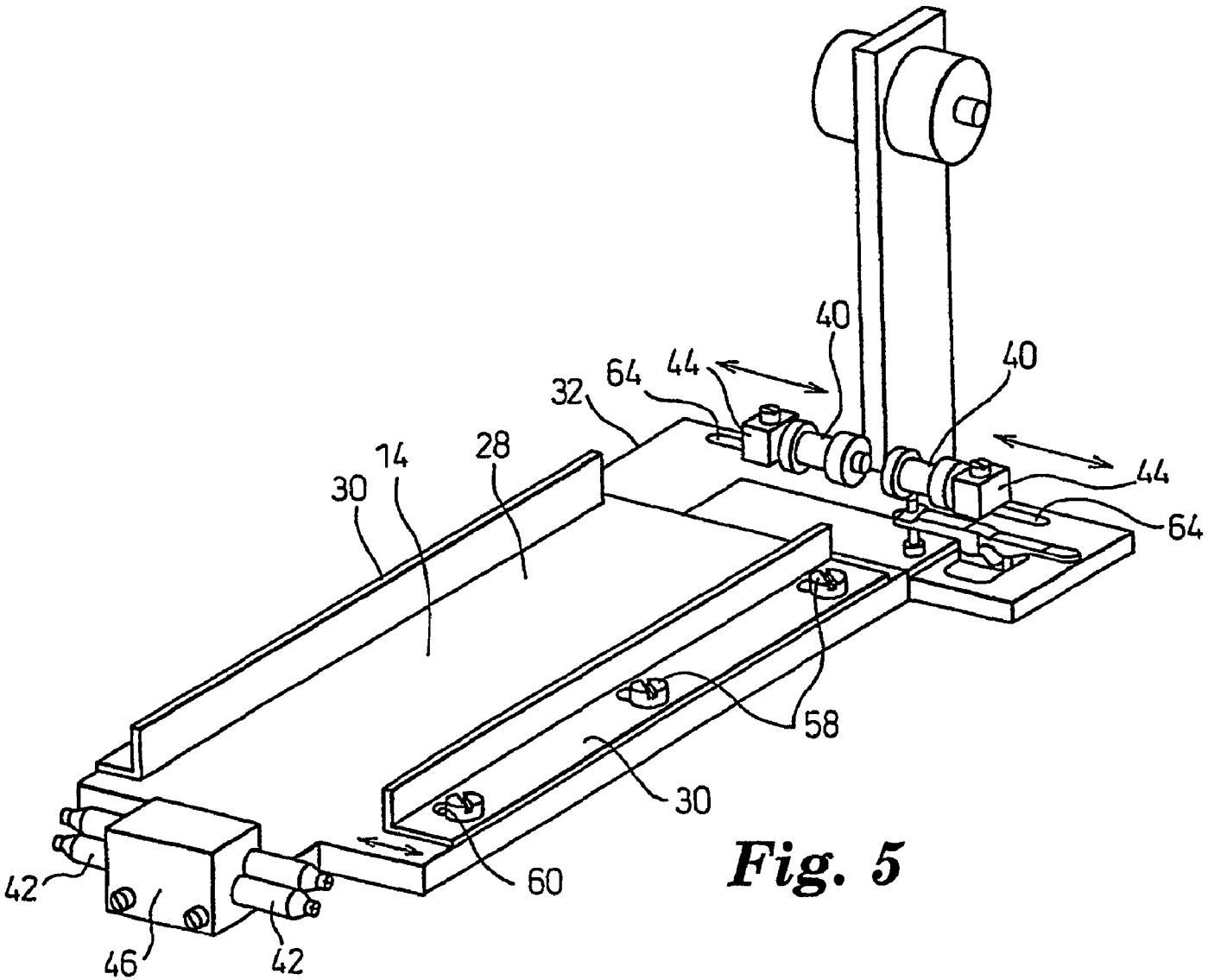
FIG. 5 is a perspective view of a modification of the application apparatus.

For example, as shown in FIG. 5, a pair of guide walls 30 provided on a base 28 are adapted so that at least one of the guide walls 30 is movable in parallel closer to and away from the other of them. In the illustrated embodiment, a plurality of bolts 58 for fastening the one guide wall 30 to the base 28 are mounted to the base 28 through a plurality of elongate holes 60 formed on a bottom plate of the guide wall 30, whereby the guide wall 30 is movable while maintaining the parallel relationship relative to the other within a range defined by am extent of the elongate hole 60, by loosening the bolts 58. According to this structure, it is possible to properly guide various objects 12 having different lengths in the direction of the rotary axis thereof by suitably adjusting a distance between both the guide walls 30.

Figure 6:
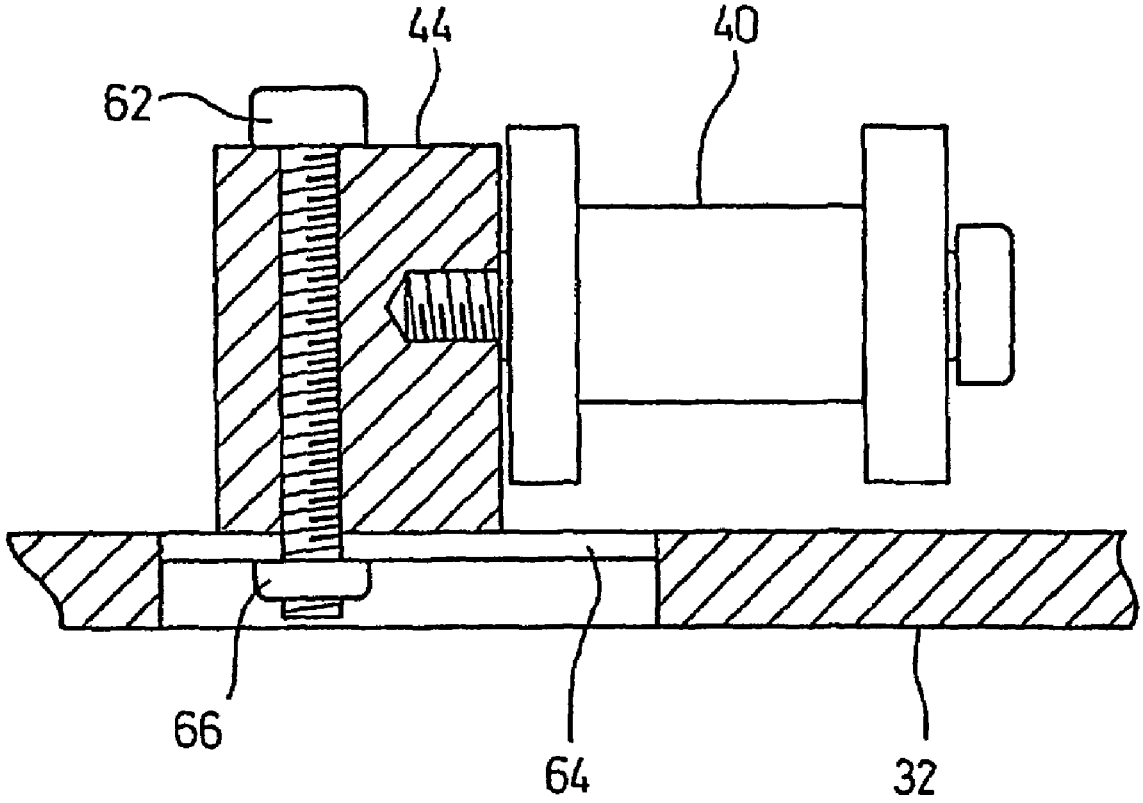
FIG. 6 is an enlarged sectional view in the vicinity of a guide roller in the application apparatus shown in FIG. 5.

Also, as shown in FIG. 5, a pair of guide rollers 40 provided on a second base 32 may be adapted so that at least one of the guide rollers 40 is movable in parallel closer to and away from the other of them. In the illustrated embodiment, both of pivot bases 44 for pivoting both the guide rollers are movable in parallel on the second base 32. In this case, as shown in FIG. 6, a bolt 62 for mounting the pivot base 44 to the second base 32 passes through a slit 64 provided in the second base 32 and is screw-engaged with a nut 66 on the lower surface of the second base 32.

Accordingly, by loosening the nut 66, the pivot base 44 is movable in parallel within a range defined by an extent of the slit 64. According to this structure, it is possible to locate and apply the double-coated pressure sensitive adhesive tape 20 at various positions on the surface 12*a* of the object 12. In this regard, the nip roller assembly 42 is preferably moved in correspondence to the parallel movement of the guide roller 40.

Figure 7:
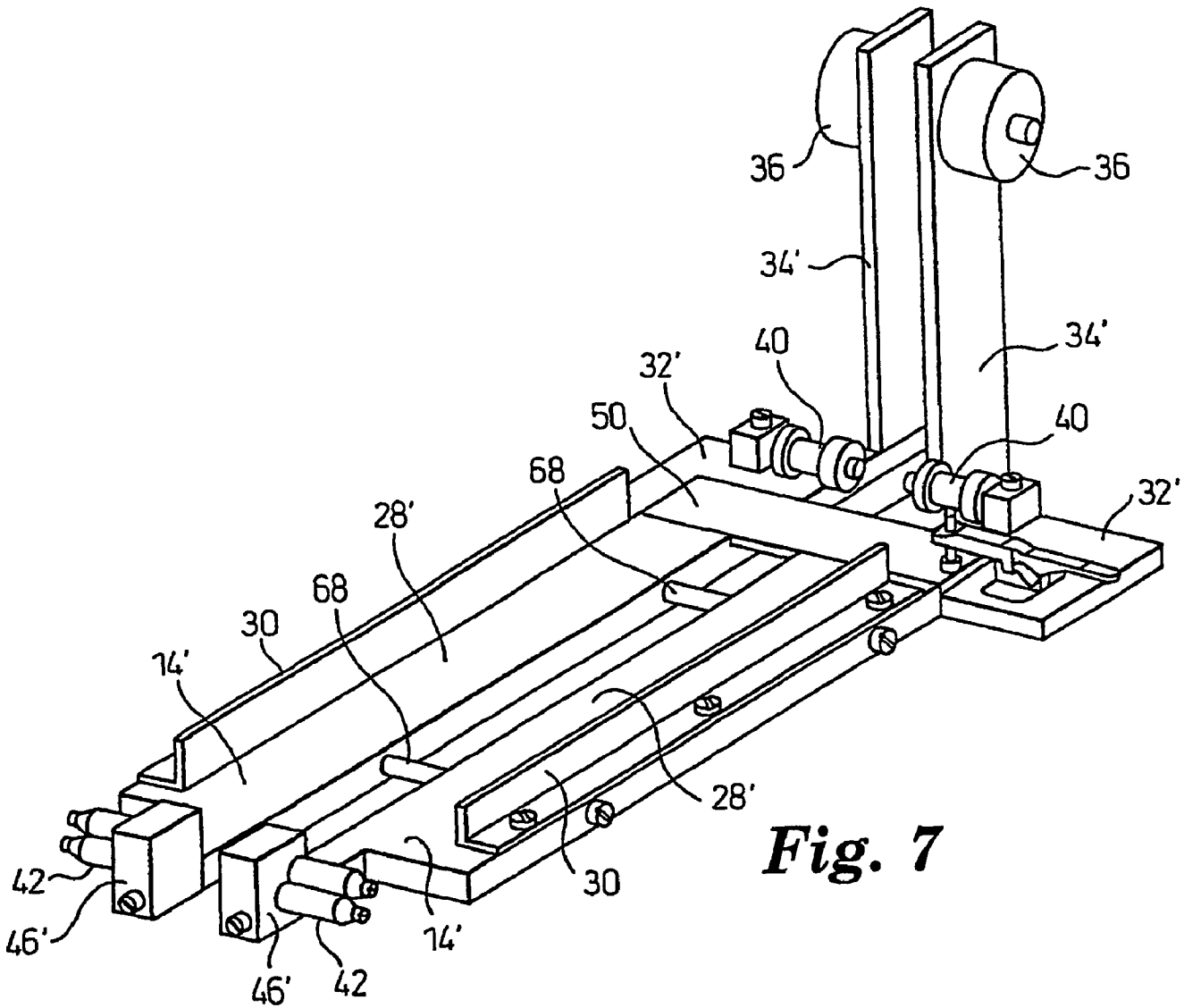
FIG. 7 is a perspective view of another modification of the application apparatus.

As shown in FIG. 7, the base 28, the second base 32, the column 34 and the pivot base 46 may be divided into two parts along a center line between both the guide walls 30 and coupled again to each other with a plurality of slide shafts 68 so that a base 281, a second base 321, a column 34' and a pivot base 46' of the respective divided pairs are movable in parallel closer to and away from the others. According to this structure, it is possible to apply the double-coated pressure sensitive adhesive tapes 20 at predetermined positions apart from the axial opposite ends of any of various objects 12 having different lengths in the direction of the rotary axis thereof in correspondence to a length of the slide shaft 68.

Figure 8:
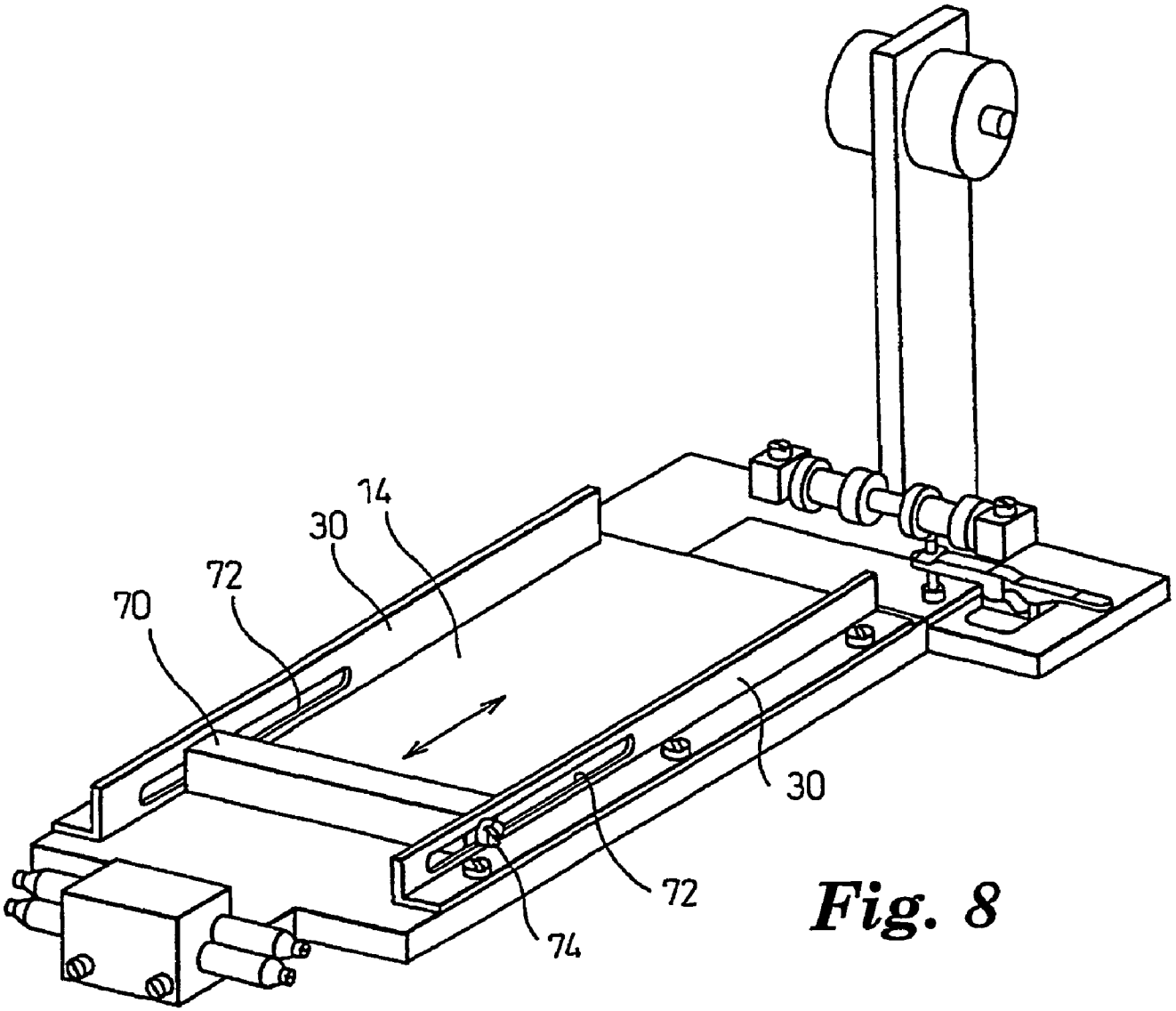
FIG. 8 is a perspective view of a further modification of the application apparatus.

As shown in FIG. 8, a pair of guide walls 30 may be provided with a stopper 70 movable on the support surface 14 parallel to the longitudinal direction of both the guide walls 30. In the illustrated embodiment, the stopper 70 is fixed to the guide walls 30 by means of a bolt 74 passing through an elongate hole 72 formed in the respective guide wall 30. Accordingly, by loosening the bolt 74, the stopper 70 is movable in parallel within a range defined by a length of the elongate hole 72. The stopper 70 operates to abut to the surface 12*a* of the object 12 when the object 12 is placed on the support surface 14 to define a starting position of the rolling of object 12. According to this structure, it is possible to suitably adjust a rolling distance of the object 12 on the support surface 14 even if the object 12 has any outer dimension, as well as to approximately define a position of the leading edge of the double-coated pressure sensitive adhesive tape 20 to be extended on the support surface 14.

Figure 9:
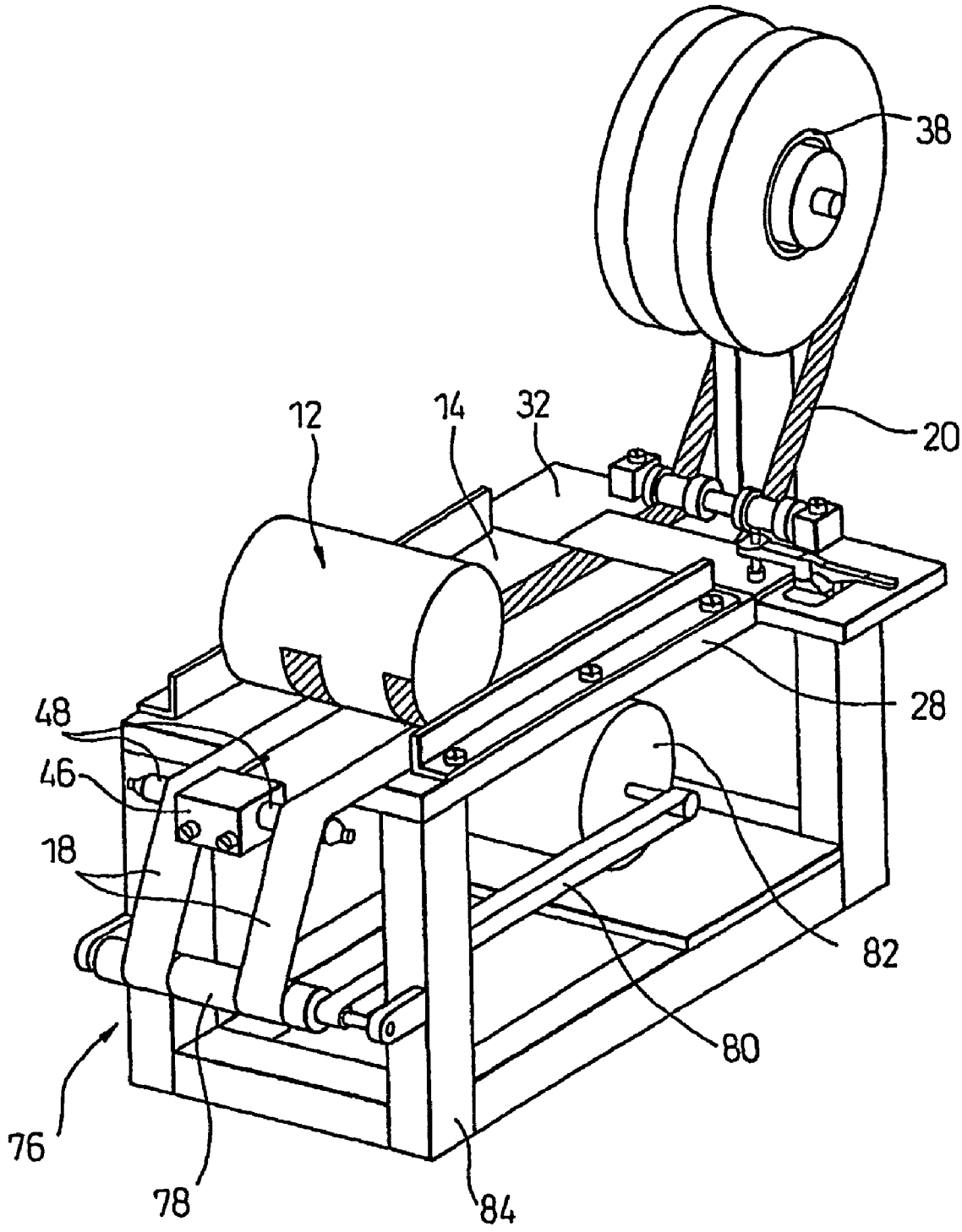
FIG. 9 is a perspective view of a furthermore modification of the application apparatus.

As shown in FIG. 9, a winding device 76 may be provided downstream from the nip rollers 48 as seen in the tape feeding direction, for automatically winding the release papers 18 peeled off from the double-coated pressure sensitive adhesive tapes 20. The winding device 76 includes a winding bar 78 to which a leading end of the release paper 18 is fixedly coupled, and a drive source 82 for rotating the winding bar 78 via a power transmission mechanism 80. The winding bar 78 and the drive source 82 are held by a bed 84 for supporting the base 28 and the second base 32. The winding device 76 operates to automatically winding the release paper 18 laid on the support surface 14 in the preparation stage of the tape application to the object 12 described before so that a predetermined length of the double-coated pressure sensitive adhesive tape 20 with the release paper 18 is withdrawn from the respective reel 38 and the leading edge of the double-coated pressure sensitive adhesive tape 20 is automatically located at a defined position on the support surface 14. According to this structure, when the application of the tapes is continuously carried out on a number of objects 12, the preparation stage for every object 12 can be automated to effectively save the operation time. Since the nip roller assembly 42 shown in FIG. 2 can be eliminated in this case, one nip roller 48 is provided on each side of the pivot base 46 in the illustrated embodiment.

Figure 10:
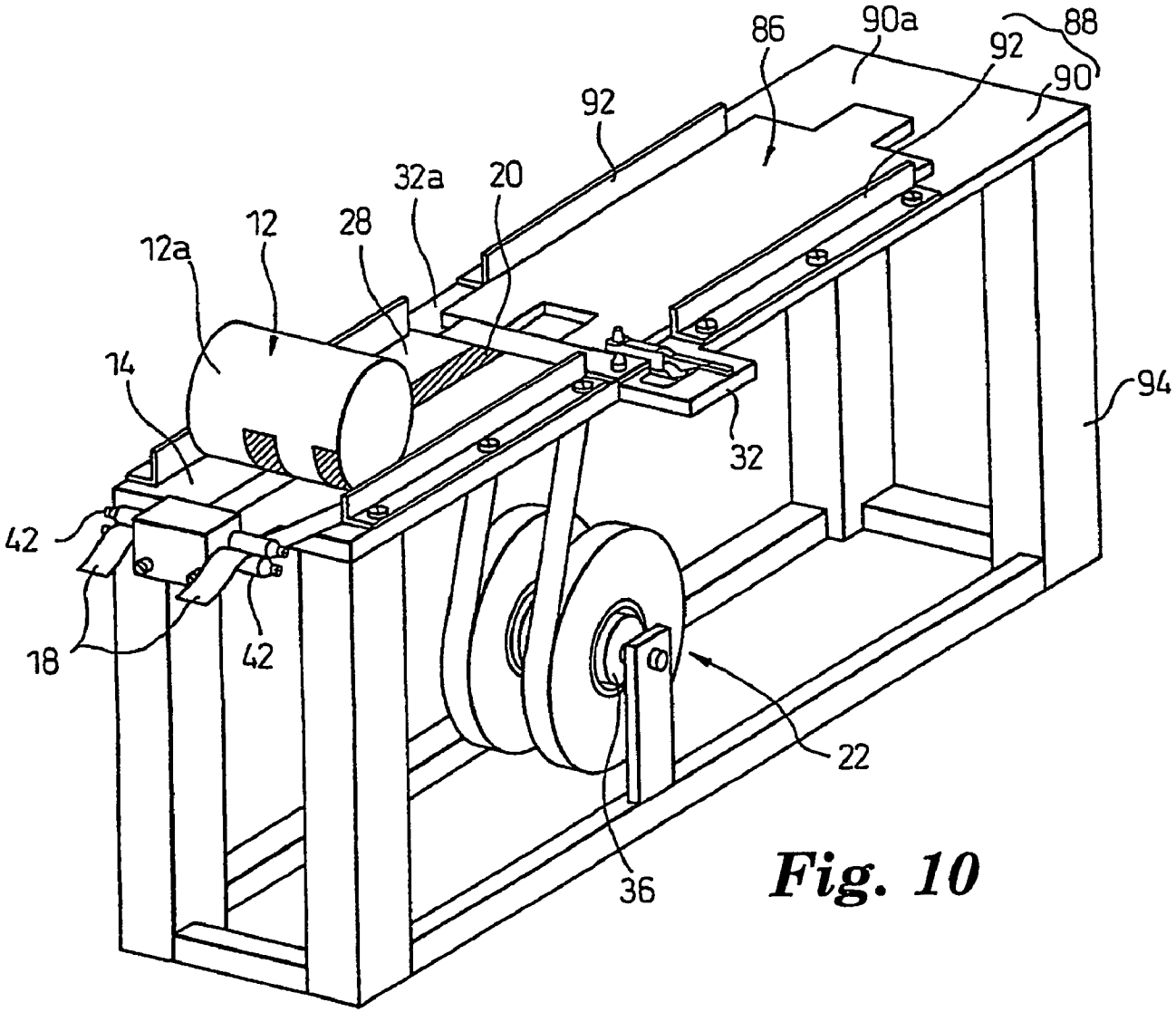
FIG. 10 is a perspective view of a still further modification of the application apparatus.

As shown in FIG. 10, an object supporting section 16 may be coupled to a cover member support 88 for supporting a cover member 86 for covering the surface 12*a* of the object 12. In the illustrated embodiment, the cover member support 88 includes a plate-like third base 90 coupled integral with the second base 32 on the opposite side of the base 28 and having an upper surface 90*a* extending in the same plane as the upper surface 32*a* of the second base, and a pair of guide walls 92 provided on the upper surface 90*a* of the third base 90 and extending parallel to each other. The base 28, the second base and the third base 90 are stationarily held on a common bed 94.

Figure 11:
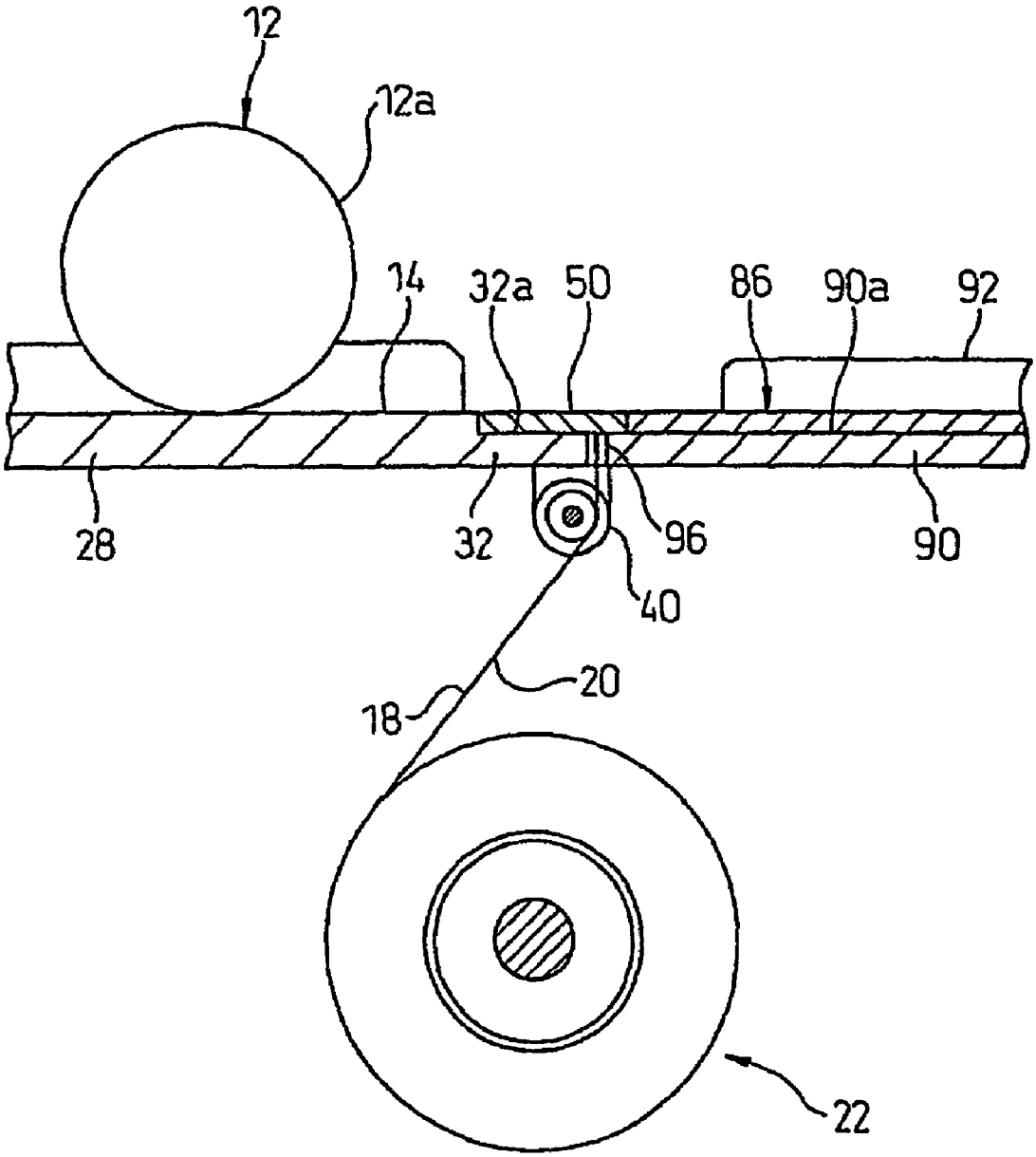
FIG. 11 is an enlarged sectional view of a main part of the application apparatus shown in FIG. 10.
Figure 12:
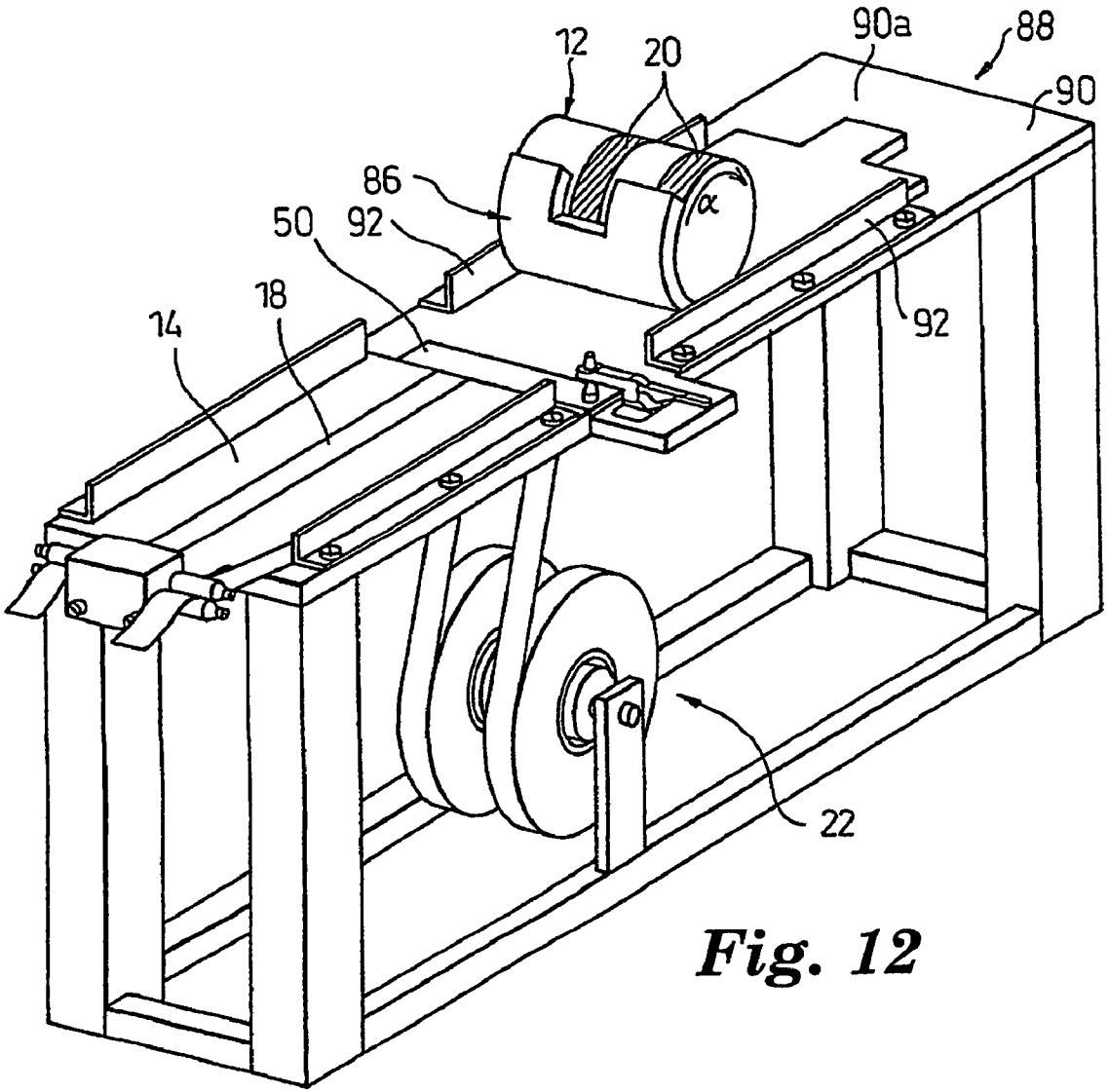
FIG. 12 is a perspective view of the application apparatus of FIG. 10, illustrating the cover-fixing operation.

According to this structure, the tape carrying section 22 is provided beneath the second base 32, and a pair of roll mounting plates 36 are held in a rotatable manner by the bed 94. The pair of guide rollers 40 (only one is shown) are provided on the lower surface of the second base 32 as shown in FIG. 11. A through-hole 96 passes through the second base 32 between upper and lower surfaces thereof at a position capable of being overlaid with the presser plate 50. Each of the two double-coated pressure sensitive adhesive tapes 30 with the release paper delivered from the tape carrying section 22 is brought into contact via the release paper 18 with the outer circumference of the guide roller 40 located at a corresponding position, and guided through the through hole 96 of the second base 32 upward to the upper surface 32*a* and further to the support surface 14.

The cover member 86 has a shape capable of covering the surface 12*a* of the object 12 and is disposed on the upper surface 90*a* of the third base 90 in a flatly extended state. Then, the object 12 to which surface 12*a* is applied with the two double-coated pressure sensitive adhesive tapes 20 according to the above-mentioned procedure on the support surface 14 is further is rolled to get over the presser plate 50 after the double-coated pressure sensitive adhesive tapes 20 have been cut by the presser plate 50, and is further rolled on the cover member 86 placed over the third base 90 in the arrowed direction (x. At this time, the object 12 is guided in the predetermined direction by the pair of guide walls 92. Thereby, the cover member 86 is appropriately fixed to the surface 12*a* of the object 12 via the two double-coated pressure sensitive adhesive tapes 20.

If a cylindrical carrier is the object 12 and a sheetlike mat cut to have a desired shape is the cover member 86, the above structure is very conveniently applicable to the assembling process of the above-mentioned catalytic converter for cleaning exhaust gas. In this case, after the double-coated pressure sensitive adhesive tapes 20 have been applied to the outer circumference of the carrier, the carrier is continuously rolled without interrupting the operation to properly wind and fix the mat around the carrier, whereby the speedup of the assembling process of the catalytic converter is further enhanced.

While the preferred embodiment of the present invention and various modification thereof have been described above, the present invention should not be limited thereto but includes many other arrangements within the disclosure of the scope of claim for patent.

For instance, in the above embodiment, the tape cutting section 26 is adapted to cut the double-coated pressure sensitive adhesive tape 20 while leaving the release paper 18 on the support surface 14, by applying a tensile force solely to the double-coated pressure sensitive adhesive tape 20 after the double-coated pressure sensitive adhesive tape 20 with the release paper 18 has been fixedly nipped between the upper surface 32*a* of the second base 32 and the lower surface 50*a* of the presser plate 50 disposed at the closed position on the second base 32. This structure is particularly effective because the risk of cutting the release paper is assuredly avoidable even if the double-coated pressure sensitive adhesive tape is composed of a weak substrate such as non-woven cloth breakable by a relatively small tensile force. According to the present invention, since the striplike continuous release paper plays a role in holding the double-coated pressure sensitive adhesive tape on the support surface and continuously delivering the same, it is important that the release paper never be cut at any position throughout a whole length of the double-coated pressure sensitive adhesive tape in a roll form. When the double-coated pressure sensitive adhesive tape composed of a substrate difficult to be cut by a tensile force is used, however, a tape cutting knife may be provided, for example, at a downstream side upper edge of the presser plate 50 as seen in the tape feeding direction. In this case, it is necessary to take a position and a shape of a knife edge into account so that the release paper 18 is not cut when the tape is cut.

The inventive application apparatus may be adapted to apply a single double-coated pressure sensitive adhesive tape or simultaneously apply three double-coated pressure sensitive adhesive tapes or more to one object. In such a case, in the above embodiment, the number or arrangement of the component such as a roll attachment plate 36, a guide roller 40, a nip roller 48 or others may be changed in accordance with the required number of double-coated pressure sensitive adhesive tapes 20. If it is unnecessary to accurately determine positions of the double-coated pressure sensitive adhesive tapes, the components for contributing to the positioning of the tape, such as a guide wall 30, a guide roller 40, a nip roller 48 or others may be optionally eliminated.

As apparent from the above description, according to the present invention, it is possible to quickly and properly wind double-coated pressure sensitive adhesive tapes on an surface of an object irrespective of the number of the tapes. As a result, an article with adhesive tapes can be manufactured in a stable manner at a good productivity without a skill of the operator. Also, according to the present invention, when a carrier low in bulk density and rich in softness is covered during a process for producing a catalytic converter for cleaning exhausted gas, it is possible to quickly and properly fix a mat on the outer circumference of the carrier while assuredly preventing the surface layer of the mat from being damaged caused by the application of the double-coated pressure sensitive adhesive tape.

We claim:

1. An application method for winding and applying a double-coated pressure sensitive adhesive tape around a surface of an object, characterized in that said method comprises:

providing a support surface for supporting an object while allowing a free rolling of the object;

holding a double-coated pressure sensitive adhesive tape with a release paper attached to one side of the tape in a condition where the tape is laid on the support surface with an adhesive surface of the tape to which the release paper is not attached facing outward;

rolling the object on the support surface so as to wind and apply the double-coated pressure sensitive adhesive tape around a surface of the object while automatically peeling the release paper; and cutting the double-coated pressure sensitive adhesive tape at a trailing end of a tape potion applied on the surface of the object while leaving the release paper on the support surface.

2. An application method as defined in claim 1, wherein holding the double-coated pressure sensitive adhesive tape in the condition where the tape is laid on the support surface includes locating the double-coated pressure sensitive adhesive tape at a desired position on the support surface.

3. An application method as defined in claim 2, wherein the object is a carrier with an outer peripheral surface used in producing a catalytic converter for exhaust emission control; and including the additional step of winding and fixing a flat sheet-like mat around the outer peripheral surface of the carrier via the double-coated pressure sensitive adhesive tape.

* * * * *

UNITED STATES PATENT AND TRADEMARK OFFICE

CERTIFICATE OF CORRECTION

PATENT NO. : 7,252,731 B2
APPLICATION NO. : 10/432117
DATED : August 7, 2007
INVENTOR(S) : Shinichi Kaneko It is certified that error appears in the above-identified patent and that said Letters Patent is hereby corrected as shown below:

In the Drawings: Sheet 1 of 11 (Fig. 1) – Line 1 (Reference Numeral 20) – Below "12a" delete "20" and insert -- 20' --, therefor.

Column 4 – Line 43 – After "thereof" insert -- . --.

Column 5 – Line 25 – Delete "puffing" and insert -- putting --, therefor.

Column 5 – Line 50 – After "32a" insert -- . --.

Column 6 – Line 15 (Approx.) – After "32a" insert -- . --.

Column 8 – Line 50 – Delete "am" and insert -- an --, therefor.

Column 12 – Line 22 – In Claim 1, delete "potion" and insert -- portion --, therefor.

Signed and Sealed this

Eighth Day of July, 2008

JON W. DUDAS
*Director of the United States Patent and Trademark Office*